US005234111A

United States Patent [19]

Zlobin et al.

[11] Patent Number: 5,234,111

[45] Date of Patent: Aug. 10, 1993

[54] FLOTATION MACHINE

[76] Inventors: Mikhail N. Zlobin, ulitsa Pavlova, 12, kv. 1.; Georgy P. Permyakov, ulitsa 50 let Oktyabrya, 7, kv. 37., both of Mirny; Alexandr A. Nemarov, mikroraion Jubileiny, 91, kv. 36; Viktor M. Metsik, ulitsa Dekabrskikh sobyty, 86, kv. 32., both of Irkutsk; Jury V. Medetsky, ulitsa Moskovskaya, 30, kv. 8.; Nikolai T. Taraban, ulitsa Sovetskaya, 15, kropus 2, kv. 15., both of Mirny, all of U.S.S.R.

[21] Appl. No.: 589,379

[22] Filed: Sep. 27, 1990

[51] Int. Cl.[5] ..... B03D 1/14; B03D 1/24

[52] U.S. Cl. ..... 209/168; 209/170; 209/211; 210/512.1

[58] Field of Search ..... 209/170, 169, 168, 211; 210/221.2, 512.1; 261/122, 123, 124

[56] References Cited

U.S. PATENT DOCUMENTS

| | | | |
|---|---|---|---|
| 3,400,818 | 9/1968 | Tarjan | 209/170 |
| 4,279,743 | 7/1981 | Miller | 209/170 |
| 4,606,822 | 8/1986 | Miller | 209/170 |

FOREIGN PATENT DOCUMENTS

| | | | |
|---|---|---|---|
| 520132 | 8/1976 | U.S.S.R. | 209/170 |
| 759141 | 8/1980 | U.S.S.R. | 209/170 |
| 929227 | 5/1982 | U.S.S.R. | 209/170 |
| 935133 | 6/1982 | U.S.S.R. | 209/170 |
| 984498 | 12/1982 | U.S.S.R. | 209/170 |
| 1183180 | 10/1985 | U.S.S.R. | 209/170 |

*Primary Examiner*—Thomas M. Lithgow
*Attorney, Agent, or Firm*—Burgess, Ryan & Wayne

[57] ABSTRACT

A flotation machine including a cylindrical chamber having a tapered bottom to which there are secured a pipe for feeding a flotation pulp carrying mineral particles of fine fraction and a pipe for discharging gangue. Secured to the walls of the chamber is a trough for collecting froth concentrate, and a group of pulp aerators, whereas positioned axially inside the chamber is a group of tapered shells spaced equidistantly from one another with bases of larger diameter thereof facing the top part of the chamber and resting substantially at one tapered surface. Positioned over the chamber is a hydrocyclone for feeding mineral particles of coarse fraction, a cylindrical casing of this hydrocyclone having a pipe for evacuating the liquid phase of the flotation pulp positioned tangentially and communicating with the pipe for feeding the flotation pulp carrying mineral particles of fine fraction.

1 Claim, 2 Drawing Sheets

FLOTATION MACHINE

FIELD OF THE INVENTION

This invention relates generally to processing minerals, particularly to arrangements for beneficiating minerals by flotation of solid particles of useful ingredient of the mineral, and more particularly to a flotation machine.

The proposed flotation machine can be used with success for beneficiating virtually all types of mineral materials in which the useful ingredients are finely disseminated in the mineral. Such minerals include ores of ferrous, non-ferrous and rare metals, non-metallic minerals, coal, and diamond-containing minerals.

BACKGROUND OF THE INVENTION

When beneficiating minerals by flotation, it is necessary that this mineral be preliminarily comminuted to the size of solids allowing to carry out the process of flotation. The optimum size of solid particles of the useful ingredient capable of floating up from the volume of the flotation pulp is different for each type of mineral, and depends largely on the density of the useful ingredient in such a mineral.

For example, with regards to an ore mineral beneficiated by widely known flotation machines the average size of solids normally ranges from 0.01 to 0.1 mm. For a diamond-containing mineral the optimum size of particles capable of floating up from the body of the flotation pulp is not more than 0.5 mm.

Reducing a mineral to the optimum particle size is accompanied by excessive comminution of the useful ingredient disseminated in the mineral to a size which is more than the upper limit of floatability, or to a size which is close to the optimum. As is known, reduction in the size of solid particles of the useful ingredient affects the value of such a useful ingredient. Such a loss of value is especially pronounced when over-comminuting a diamond-containing mineral.

It is also to be noted that the greater part of overall expenditures associated with beneficiating minerals falls on comminution, and is as large as 40% of all expenditures associated with mineral processing.

Therefore, it is especially important to increase the upper limit in the size of mineral particles subjected to processing in a flotation machine. The accompanying advantage is an increase in the efficiency of the equipment for comminuting minerals. For example, an increase in the upper limit of particle size from 0.2 to 0.3 mm results in a 30% growth in the efficiency of ball mills. In some instances larger grain-size concentrates are more amenable to subsequent processing. Large diamond crystals have a higher value than small ones.

With respect to a diamond-containing mineral, the upper size limit of the particles of a useful ingredient of the mineral capable of floating up from the body of a flotation pulp in the prior art floatation machines is not more than 1 mm.

Along with conventional floatation machines in which solid particles of a mineral float up from the body of the aerated pulp conveyed to a pulp circulation chamber, there are known froth floatation machines in which solid particles of a mineral are fed to the surface of the froth layer of the flotation pulp. As the froth layer can reliably hold solids of the useful ingredient of the mineral twice as large in size as solid particles of the useful ingredient capable of floating up from the body of the pulp, it seems more economically advantageous to use combination-type flotation machines.

There is known a flotation machine (cf., SU, A, 759,141) in which the froth concentrate has an upper size limit of solid particles of a diamond-containing mineral of 2 mm. This flotation machine includes a vertical cylindrical chamber for circulating the flotation pulp having a tapered bottom over which a funnel for feeding the flotation pulp is positioned. The top portion of the chamber has the form of a horn the base of which holds an annular comb. Gaps between the teeth of the comb serve to screen solid particles of fine fraction of the mineral capable of floating up from the body of the aerated pulp. Provided between the funnel for feeding the flotation pulp and top edge of the chamber is a Segner's wheel whose rotation causes the flotation pulp to move on the wheel blades and be thrown to the walls of the horn onto the surface of the annular comb. Solid mineral particles of coarse fraction of the useful ingredient are retained at the surface of the comb to be then carried to the surface of the froth layer, whereas solid particles of the fine fraction of the useful ingredient with the liquid phase of the flotation pulp are conveyed through the gaps of the comb to the interior of the chamber wherefrom the solid particles of the useful ingredient float up to the froth layer.

However, in this flotation machine solid mineral particles of coarse fraction spread non-uniformly on the surface of the comb due their higher concentration at points where the flotation pulp leaves the blades of the Segner's wheel. Therewith, some solid particles of the useful ingredient of coarse fraction are carried to the interior of the chamber resulting in irretrievable losses of the useful ingredient.

There is also known a flotation machine for beneficiating minerals (cf., SU, A, 1,183,180) capable of distributing solid mineral particles of coarse fraction across the froth layer of flotation pulp more uniformly. This flotation machine comprises a vertical cylindrical chamber for circulating the flotation pulp having a tapered bottom to which there are secured a pipe for feeding the flotation pulp carrying mineral particles of fine fraction and a pipe for discharging gange, an annular trough for collecting froth concentrate secured at the top of the chamber for circulating the flotation pulp, a group of tapered shells secured axially in the chamber for circulating the flotation pulp and spaced equidistantly in terms of the height of the chamber, the height and inclination angles of the generating lines of the tapered surfaces of the shells to their axes of rotation being substantially the same, the bases of larger diameter of the shells facing the top part of the chamber resting on one tapered surface outside the shells, the inclination angle of the generating line of this tapered surface to its axis of rotation being smaller than the inclination angle of the generating lines of the tapered surfaces of the shells, a group of pulp aerators secured at the walls of the pulp circulation chamber, and a means for feeding mineral particles of coarse fraction positioned over the chamber for circulating the flotation pulp.

In this flotation machine the means for feeding mineral solids of coarse fraction to the surface of the froth layer includes a rotatable plate having a tapered surface to serve as a guide of a flotation pulp carrying solid particles, the base of larger diameter of this tapered plate facing the froth layer. Provided inside the plate is a receiver with an annular slotted hole positioned over the peripheral edge of the plate wherethrough compressed air escapes.

This construction of the means for feeding mineral particles of coarse fraction ensures sufficiently uniform spread of the mineral particles of coarse fraction across the surface of the froth layer. However, along with solid particles of the mineral, the entire liquid phase of the flotation pulp containing a substantial quantity of oily froth suppressing reagents are conveyed to the pulp circulation chamber, which can lead to breaking of the froth layer whereby this layer partially loses its capacity to hold mineral solids of the useful ingredient. The total quantity of oily reagents is normally not less than by one order of magnitude greater than the quantity of such reagents necessary for wetting the solid particles of the useful ingredient present in the mineral.

In addition, this means for feeding mineral solids of coarse fraction is structurally overcomplicated. It is further to be noted that most of the oily reagent is evacuated from the chamber with the froth concentrate, this froth concentrate tending to accumulate in the recycling water in the course of a subsequent treatment thereof, and a quantity of the reagent is inevitably lost in dump waste products to pollute the environment.

It is therefore an object of the present invention to provide a flotation machine capable of ensuring a higher yield of large-size particles of the useful ingredient of the mineral being beneficiated.

One more object is to structurally simplify the means for feeding mineral solids of coarse fraction.

SUMMARY OF THE INVENTION

The objects are attained by that in a flotation machine for beneficiating minerals comprising a vertical cylindrical chamber for circulating a flotation pulp having a tapered bottom to which there are secured a pipe for feeding the flotation pulp carrying mineral particles of fine fraction and a pipe for discharging gangue, an annular trough for collecting froth concentrate secured at the top of the pulp circulation chamber, a group of tapered shells secured axially in the pulp circulation chamber and spaced equidistantly heightwise of the chamber, the height of the tapered shells and inclination angles of the generating lines of their tapered surfaces to their axes of rotation being substantially equal, their bases of larger diameter facing the top of the chamber and resting at one tapered surface outside the tapered shells having an inclination angle of its generating line to its own axis of rotation smaller than the inclination angle of the generating lines of the tapered surfaces of the shells, a group of aerators for aerating the flotation pulp secured at the walls of the pulp circulation chamber, and a means for feeding mineral particles of coarse fraction positioned over the pulp circulation chamber, according to the invention, the means for feeding mineral particles of coarse fraction has the form of a hydrocyclone having at least one pipe for feeding the flotation pulp carrying mineral particles of coarse fraction positioned tangentially at the cylindrical casing of the hydrocyclone, and a pipe for evacuating the liquid phase of the flotation pulp positioned tangentially over the pipe for feeding the flotation pulp carrying mineral particles of coarse fraction communicating with the pipe for feeding the flotation pulp carrying mineral particles of fine fraction secured at the tapered bottom.

In the herein proposed flotation machine for beneficiating minerals where a sufficiently simple hydrocyclone communicating with the pipe for feeding the flotation pulp carrying mineral particles of coarse fraction is used as the means for feeding mineral solids of coarse fraction, an excess oily reagent present in a free state in the flotation pulp is not admitted to the surface of the froth layer whereby its stability is maintained, but is evacuated from the cylindrical casing of the hydrocyclone together with the liquid phase of the flotation pulp, and conveyed to the interior of the chamber via the pipe of feeding the flotation pulp carrying mineral solids of fine fraction. The yield of useful ingredient in this flotation machine for beneficiating minerals can be as high as 98%. The quantity of the oily reagent necessary for operation of this machine is reduced to at least to one third of the quantity of oily reagents used in the known flotation machine.

One important advantage of the proposed flotation machine is that it is more ecologically clean as compared with the known machine.

BRIEF DESCRIPTION OF THE DRAWINGS

The invention will now be described in greater detail with reference to a specific embodiment thereof taken in conjunction with the accompanying drawings, in which.

DETAILED DESCRIPTION OF THE INVENTION

Figure 1:
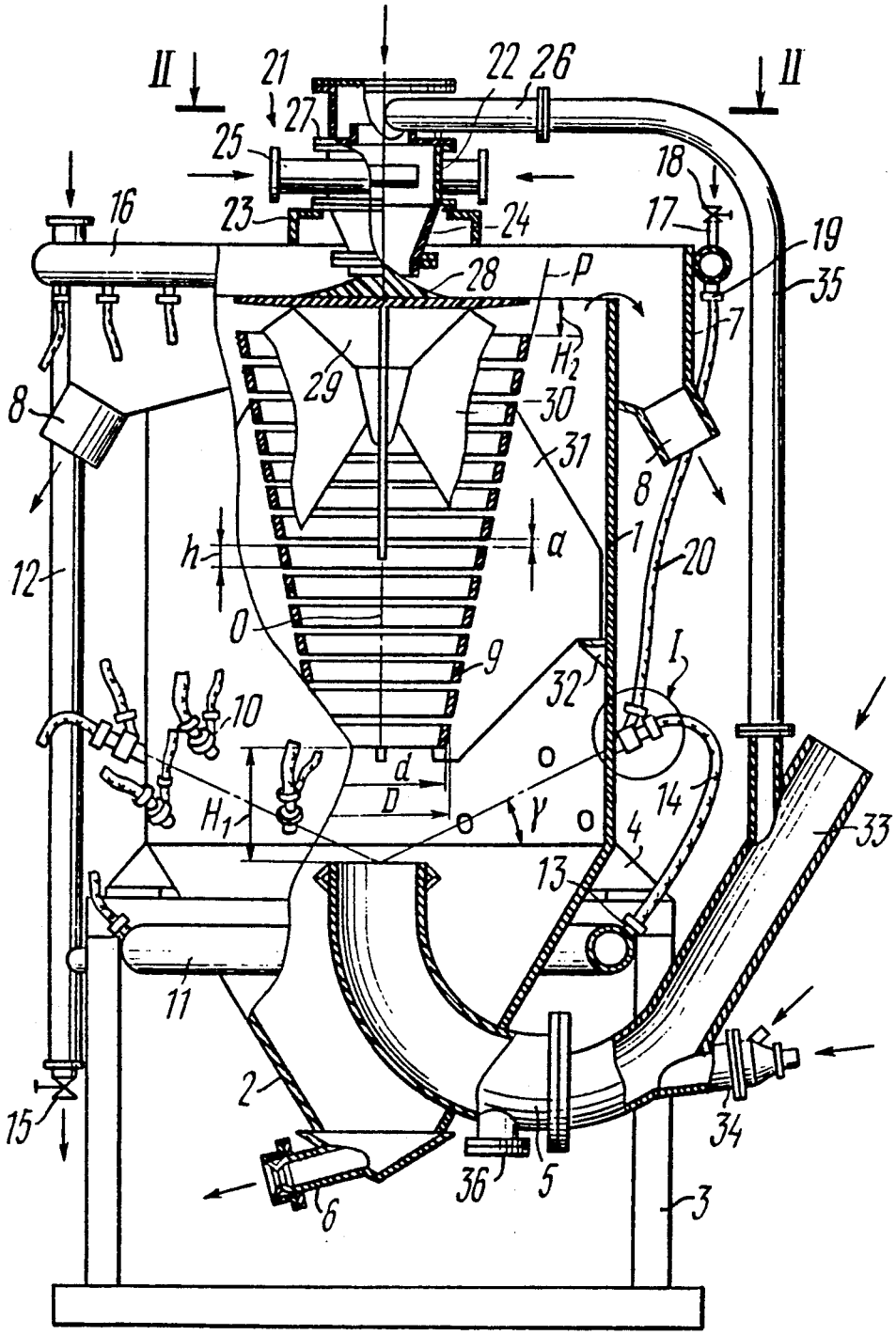
FIG. 1 is a partially longitudinal sectional view of a flotation machine according to the invention.

A flotation machine for beneficiating minerals comprises a cylindrical chamber 1 (FIG. 1) for circulating a flotation pulp having a tapered bottom 2. The cylindrical chamber 1 is mounted vertically on a frame 3, particularly on support elements 4 rigidly connected to the frame 3 such as by welding.

Secured to the tapered bottom 2 is a pipe 5 for feeding the flotation pulp containing solid mineral particles of the fine fraction. The outlet of the pipe 5 is in line with the axis O of the chamber 1.

As is known, the size of the mineral solids in a flotation pulp depends on the density of the useful ingredient of the mineral being beneficiated, and the maximum size of such solids can be different for a particular mineral.

It is also known that the composition and percentage of reagents in the flotation pulp are different for each type of mineral.

Normally, with respect to diamond-containing minerals the size of solids in flotation pulps of known compositions used in the known flotation machines ranges from 0.1 to 1 mm.

Secured further to the tapered bottom 2 is a pipe 6 for evacuating gangue.

Provided at the top part of the chamber 1 for circulating the pulp is an annular trough 7 for collecting a froth concentrate to which the froth concentrate overflows by gravity from the chamber 1. The annular trough 7 for collecting the froth concentrate is defined by the top part of the chamber 1 and a cylindrical shell secured outside the chamber 1 and positioned coaxially therewith. Pipes 8 for discharging the froth concentrate are attached to the bottom of the trough 7.

Secured axially in the chamber 1 for circulating the flotation pulp is a plurality of tapered shells 9. These tapered shells 9, have the same height h ranging from 100 to 150 mm. The angle of taper of the generating lines of the tapered surfaces of the shells 9 to their axes of rotation are the same for all the shells 9, and can range from 15° to 30°.

The tapered shells 9 are spaced at equal distances "a" from each other along the height of the cylindrical chamber 1. This distance "a" depends on the size of solid particles of the fine fraction of the mineral, and normally ranges from 3r to 10r, where r is the average diameter of the particles of the mineral of fine fraction.

The diameter 3 of the base of the adjacent tapered shells 9 are different, increasing from the bottom to the top tapered shall 9. The bases of all the tapered shells 9 of larger diameter D face the top of the chamber 1, whereas bases of smaller diameter d face the tapered bottom 2 of the chamber 1. All of the bases of the tapered shells 9 of larger diameter D rest at one tapered surface P outside the tapered shells 9, i.e., the inclination angle of the generating line of the tapered surface P to its axis of rotation is smaller than the inclination angle of of the generating lines of the tapered surfaces of the shells 9 by 5° to 10°, that is this angle can range from 10° to 25°. In any two adjacent shells 9 the diameter D of the larger base of the underlying shell 9 is greater than the diameter d of the smaller base of the overlying shell 9.

The diameter d of the smaller base of the lowermost tapered shell 9 is 1.5 to 2 diameters of the outlet hole of the pipe 5 for feeding the flotation pulp containing fine fraction particles of the mineral being beneficiated. Provided between the lowermost tapered shell 9 and the top edge of the pipe 5 is a clearance indicated at $H_1$ and amounting to between 0.7 and 1.0d.

A clearance $H_2$ is also allowed between the uppermost shell 9 and the top edge of the chamber 1, this clearance preferably ranging from 200 to 300 mm, and acting to reduce turbulence of the flow of pulp at the upper layers thereof.

The number of tapered shells 9 depends on the height of the cylindrical chamber 1 for circulating the flotation pulp. In a modified form of the proposed flotation machine shown in FIG. 1 fourteen such tapered shells 9 are provided.

The flotation machine further comprises a group of pulp aerators 10, tubular casings of these aerators being secured outside at the walls of the chamber 1 of its bottom portion. Used as the pulp aerators 10 are any known suitable aerators feeding to the interior of the chamber 1 a directed flow of an aerated liquid axially of the hole made in the tubular body of the aerator 10. The number of aerators 10 depends on the volume of the chamber 1. Preferably, the number of aerators is such as to ensure that the density of air bubbles be sufficiently uniform across the interior of the chamber 1. The tubular bodies of the aerators 10 are arranged in two rows about two circles at different levels height-wide of the chamber 1. Each such row has an even number of equidistantly spaced aerators. In the embodiment of a floatation machine described herein the overall number of aerators 10 is sixteen, each row having eight aerators 10. The axes of the tubular bodies of the aerators 10 rest in pairs in radially extending planes of the cylindrical chamber 1, and are positioned at an acute angle $\gamma$ to its axis 0. Normally, this angle is between 60° and 30°.

Secured to the frame 3 outside the tapered bottom 2 x is an annular tubular header 11 for feeding a liquid communicating via a vertical pipe 12 with a source (not shown) of liquid under a pressure of 2 to 2.5 atm. The tubular header 11 has nipples 13 equal in number to the number of aerators 10, one end of a flexible hose 14 being connected to each such nipple, the other end of the hose 14 being connected to the tubular body of one of the aerators 10. A shut-off valve 15 is provided at the bottom portion of the vertical pipe 12.

Secured on the trough 7 for collecting the froth concentrate is a tubular annular header 16 to feed compressed air to the pulp aerators 10, this header 16 communicating via a pipe 17 with a source (not shown) of compressed air. The pressure of compressed air in the header 16 is 0.1–0.2 atm lower than the pressure of liquid in the header 11. A shut-off valve 18 is provided at the pipe 17. The size of particles of the coarse fraction of the mineral being beneficiated is at least twice as large as the size of fine fraction particles of the mineral. For a diamond-containing mineral the size of particles of coarse fraction is 0.8 to 2 mm. With respect to other types of minerals, the size of solid particles of the coarse fraction is proportional to the density of particles of the useful ingredient of this type of mineral. Provided at the tubular header 16 for feeding compressed air are nipples 19 equal in number to the number of aerators 10, one end of a flexible hose 20 being connected to each such nipple 19, whereas the other end of this hose 20 is connected to the tubular body of one of the aerators 10.

The flotation machine also comprises a means 21 for feeding mineral particles of coarse fraction in the form of a hydrocyclone to control the pressure of compressed air. The cylindrical casing 22 of the hydrocyclone is positioned over the chamber 1 in line with its axis O, and is mounted on a frame 23 rigidly connected, such as by welding, to the trough 7 for collecting the froth concentrate.

Figure 2:
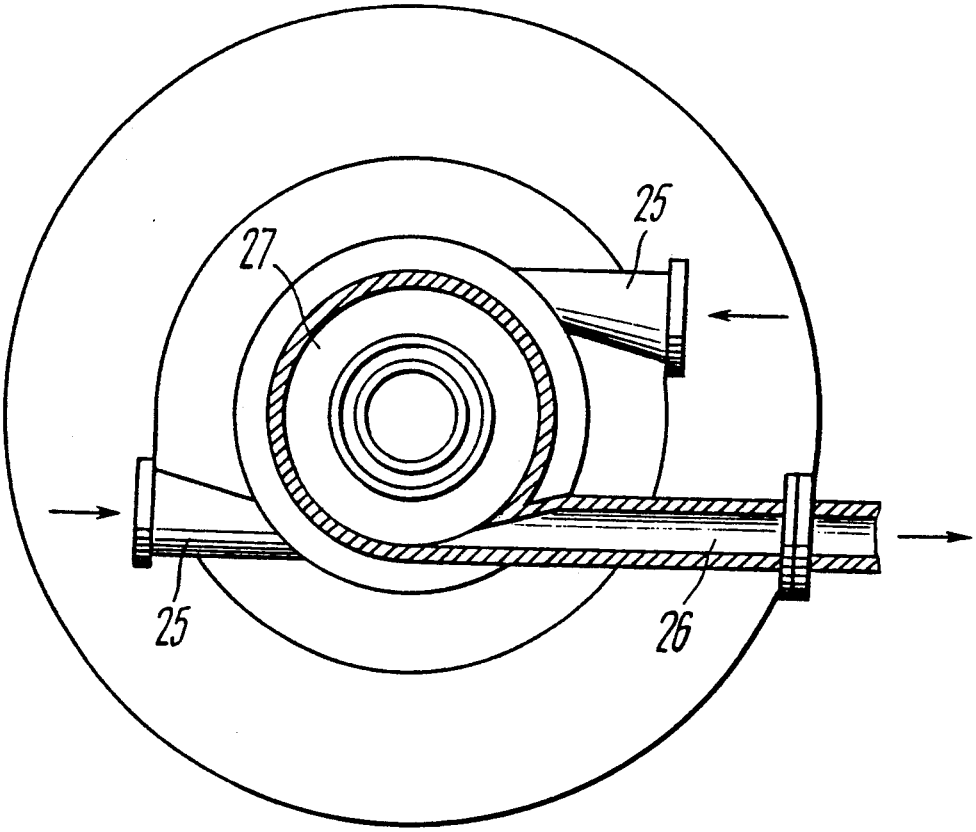
FIG. 2 is an enlarged section of the proposed flotation machine taken along the line II—II in FIG. 1.

The cylindrical casing 22 of the hydrocyclone has a funnel 24 to evacuate solid particles of the mineral positioned axially of the casing 22, and at least one pipe for feeding the flotation pulp containing solid mineral particles of the coarse fraction positioned tangentially. In the modification of the proposed flotation machine shown in FIGS. 1 and 2 the hydrocyclone has two pipes 25 (FIG. 2) with axes thereof resting in one plane substantially perpendicular to the axis of the casing 22 at equal distance from each other.

The hydrocyclone also includes a pipe 26 to evacuate the liquid phase of the flotation pulp secured at the cylindrical casing 22 and positioned tangentially over the pulp feeding pipes 25. The outlet hole of the pipe 26 coincides with the travel path of the pulp in the hydrocyclone as indicated by arrows in FIGS. 1 and 2.

Provided between the pipes 25 (FIG. 1) and 26 in the casing 22 of the hydrocyclone is a flange 27 having a hole therein of a diameter smaller than the diameter of the casing 22 of the hydrocyclone.

Interposed between the funnel 24 of the hydrocyclone and the upper tapered shell 9 is a plate 28 which is secured on a cone-shaped baffle element 29.

The surface of the plate 28 facing the funnel 24 is lined with a wear-resistant material and has the shape of a horn to ensure gradual admission of the mineral particles of coarse fraction to the froth layer of the flotation pulp.

The other surface of the plate 28 facing the tapered shells 9 is connected by welding to the cone-shaped baffle element 29. Secured on the cone-shaped baffle element 29 are four ribs 30 on which six top tapered shells 9 bear. Twelve lower tapered shells 9 bear on four partitions 31 secured in the interior of the chamber 1 and supported by brackets 32 rigidly secured to its walls.

The pipe 26 for evacuating the liquid phase of the flotation pulp communicates with the pipe 5 for feeding the flotation pulp carrying mineral particles of coarse fraction.

Connected to the pipe 5 is an intermediate pipe 33 communicating with a source (not shown) of flotation pulp and with a means 34 for feeding an aerated liquid of any known suitable construction. The intermediate pipe 33 is also connected to one end of a vertical pipe 35, the other and of this pipe 35 being connected to the pipe 26 for evacuating the liquid phase of flotation pulp. A discharge pipe 36 is further provided for cleaning the pipe 5.

The proposed flotation machine operates in the following manner.

The chamber 1 (FIG. 1) for circulating the flotation pulp is first occupied by water with a froth generating agent entering into the composition of the flotation pulp which is simultaneously conveyed via the pipe 5, intermediate pipe 33, means 34 for feeding the aerated liquid, and through the aerators 10 of the flotation pulp. At the same time, compressed air is admitted through the pipe 17 to the annual header 16, and is then conveyed via the flexible hoses 20 secured on the nipples 19 to the pulp aerators 10.

A liquid is fed under pressure to the annular header 11 through the vertical pipe 12, this liquid is then conveyed from the header 11 via the nipples 13 and flexible hoses 14 to the pulp aerators 10. Operation of the aerators 10 is visually monitored judging on the presence of jets of aerated liquid escaping from their outlet holes.

As the interior of the chamber 1 is filled with water, froth generating agent and aerated liquid, a stable froth layer is formed at the surface of the liquid phase of the flotation pulp. When this froth layer elevates to the top edge of the chamber 1, it starts to flow over this edge to the trough 7 for collecting the froth concentrate.

After this water and froth generating agent are fed at a rate ensuring that the level of froth layer is very close to the upper edge of the pulp circulation chamber 1. A quantity of the liquid conveyed to the chamber 1 continuously flows out of the pipe 6 for evacuating the gange. Then the flotation pulp carrying mineral particles of fine fraction capable of floating up from the volume of the aerated pulp is fed via the pipe 5 to the chamber 1.

At the same time, the flotation pulp containing mineral solids of coarse fraction is conveyed through the pipes 25 to the cylindrical casing 22 of the hydrocyclone 21.

In the cylindrical casing 22 of the hydrocyclone the flow of pulp is swirled, whereby solid particles are thrown by centrifugal forces toward the walls of the cylindrical casing 22, and then discharged via the funnel 24 to the horn-shaped surface of the plate 28. The flange 27 having an axial hole of a diameter smaller than the diameter of the casing 22 of the hydrocyclone acts to prevent entrainment of mineral solids of the coarse fraction by the liquid phase of the flotation pulp evacuated from the hydrocyclone through the pipe 26. At this surface the speed of solids is reduced, and they are uniformly conveyed to the surface of the froth layer of the pulp. Therewith, particles of the coarse fraction of the useful ingredient treated with flotation reagents are retained in the froth layer and drained into the trough 7, whereas the gangue descends to the bottom of the chamber 1 to be evacuated from the chamber 1 through the pipe 6. The liquid phase of the pulp and some finer particles of the mineral enter the top part of the cylindrical casing 22 of the hydrocyclone through the hole in the flange 27, and then are evacuated from the interior of the hydrocyclone via the pipe 26. The liquid phase of the flotation pulp containing an excess of oily reagents flows via the pipe 35, pipe 33, and pipe 5 to the interior of the chamber 1.

Evacuation of the oily reagents possessing froth suppressing properties by the liquid phase of the flotation pulp from the cylindrical casing 22 of the hydrocyclone fails to disturb the stability of the froth layer, or its carrying capacity to result in a more efficient recovery of large-size particles of the useful ingredient of the mineral. In addition, the use of the hydrocyclone makes it possible to distribute solid particles at the surface of the froth layer more uniformly.

Also, feeding the flotation pulp from the interior of the hydrocyclone to the chamber 1 necessitates a smaller total quantity of the pulp whose ingredients can pollute the environment.

As a flow of aerated pulp containing mineral particles of fine fraction is conveyed axially of the chamber 1, bubbles of air continuously entering the chamber 1 through the aerators 10 and means 34 for feeding the aerated liquid tend to adhere to particles of the ingredient of the mineral.

The flow of aerated pulp moves upwards axially of the chamber 1, predominantly inside the tapered shells 9, entraining solid particles of the mineral. In the course of its upward travel the flow expands and decelerates, becoming less turbulent. The ascending flow of aerated pulp is continuously saturated with air bubbles. At the top of the chamber 1 the tapered baffle element 29 changes the travel path of the flow toward the trough 7 for collecting the froth concentrate. The upper layer of froth carrying froth concentrate moves in the same direction to continuously overflow to the trough 7. Some solid particles of the mineral are conveyed to the clearances between the tapered shells 9. Outside the tapered shells 9 particles of the useful ingredient with air bubbles stuck thereto move upwards toward the froth layer, whereas gangue solid descend to the tapered bottom 2, and are discharged from the chamber 1 through the pipe 6.

Outside the shells 9 solid particles of the useful ingredient are flotated in a countercurrent, when air bubbles and mineral particles move in the opposite directions.

In view of the aforedescribed, particles of the useful ingredient of the fine fraction mineral continuously ascend to the froth layer, are retained in this layer, flow to the trough 7 for collecting the froth concentrate, and are discharged through the pipes 8.

The froth concentrate obtained in the proposed flotation machine includes a useful ingredient of the mineral in the form of fine and coarse fraction particles. The yield of the useful ingredient is as high as 99%.

What is claimed is:

1. A flotation machine for beneficiating minerals comprising:

a vertical cylindrical chamber for circulating a flotation pulp;

a downwardly tapered bottom connected to said vertical cylindrical chamber;

feedpipe means for feeding the flotation pulp carrying mineral particles of fine fraction, particles of the useful ingredient of the fine fraction being capable of floating up from the volume of said aerated pulp, said feedpipe means extending into said downwardly tapered bottom and oriented to open upwardly toward said vertical cylindrical chamber;

discharge pipe means connected to the tapered bottom near its lowest point for discharging gangue;

an annular trough for collecting froth concentrate at the top of said chamber;

a group of frustoconical shells each having bases of different diameters and a tapered surface secured axially in said chamber and spaced equidistantly from one another heightwise of said chamber, each of the shells having substantially the same height, substantially the same inclination angle formed by a generating line of the bases and substantially the same inclination angle formed by a generating line of the tapered surfaces, wherein the bases of larger diameter of said frustoconical shells facing the top part of said chamber rest substantially at one tapered surface outside said shells, the inclination angle of the generating line of the tapered surface of the bases of larger diameter to the axis of rotation being smaller than said inclination angle of the generating line of the tapered surface of each shell;

aerator means for aerating the flotation pulp secured to the walls of said chamber and communicating therewith to provide aerated water into said chamber;

means for feeding mineral particles of coarse fraction, particles of the useful ingredient of the coarse fraction being capable of floating in the froth layer of the flotation pulp, in the form of a hydrocyclone having a cylindrical casing positioned axially over said chamber and a downwardly tapering outlet directed downwardly to feed the coarse particles to said chamber;

feedpipe means for feeding the flotation pulp carrying mineral particles of coarse fraction positioned tangentially at said cylindrical casing of the hydrocyclone; and evacuation means for evacuating the liquid phase of the flotation pulp positioned tangentially at said casing of the hydrocyclone over said feedpipe means for feeding the flotation pulp carrying mineral particles of coarse fraction and connected to said feedpipe means for feeding the flotation pulp carrying mineral particles of the fine fraction.

* * * * *